United States Patent [19]

Buckner et al.

[11] 4,450,739

[45] May 29, 1984

[54] METHOD AND APPARATUS FOR TRANSFERRING SLUGS FROM A CONVEYOR TO A SLUG CUTTING DEVICE

[75] Inventors: John G. Buckner, Ramseur; Cletus E. Lineberry, Staley; Jimmy W. Harris, Siler City, all of N.C.

[73] Assignee: Auto-Systems & Service, Inc., Staley, N.C.

[21] Appl. No.: 292,686

[22] Filed: Aug. 13, 1981

[51] Int. Cl.[3] ..... B28B 11/14; B26D 7/06

[52] U.S. Cl. ..... 83/23; 83/404.3; 83/425.2; 83/437; 83/651.1

[58] Field of Search ..... 83/651.1, 404.3, 23, 83/425.2, 437

[56] References Cited

U.S. PATENT DOCUMENTS 4,173,910 11/1979 Lineberry et al. ..... 83/651.1 X 4,173,911 11/1979 Lineberry et al. ..... 83/651.1 X 4,328,724 5/1982 Lingl ..... 83/651.1 X

*Primary Examiner*—Donald R. Schran

*Attorney, Agent, or Firm*—Mills and Coats

[57] ABSTRACT

The present invention relates to a brick handling system for conveying brick slugs to and through a slug cutting device such as a wire bank cutter. More particularly, the system comprises an off bearing belt that conveys slugs to a discharge point where an over-hanging pusher-puller assembly acts to pull one slugs off said off bearing belt onto a slug support. After this a second slug is transferred to the discharge point such that said first and second slugs are horizontally aligned and disposed in side-by-side relationship. At this point, the same pusher-puller assembly is operative to engage said first slug on said slug support and push the same towards said second slug, engaging said second slug and continuing to transfer both first and second slugs across said conveyor towards the wire bank cutter.

5 Claims, 8 Drawing Figures

METHOD AND APPARATUS FOR TRANSFERRING SLUGS FROM A CONVEYOR TO A SLUG CUTTING DEVICE

FIELD OF THE INVENTION

The present invention relates to brick handling systems and more particularly to a method and apparatus for conveying two slugs at a time from a slug delivery system to an adjacently disposed slug cutting device.

BACKGROUND OF INVENTION

It is recognized in the brick producing industry that certain areas or portions of the brick handling system substantially affect capacity and efficiency. One such area is that which entails conveying slugs from a conveying system to and through a slug cutting device. Traditionally, this has been accomplished with a pusher which engages and pushes one slug at a time from a conveyor or off bearing belt towards and through an adjacent wire bank cutter. Generally this approach has been inefficient and has not provided the necessary delivery speed for allowing the entire brick handling system to operate at optimum capacity and efficiency.

There have, however, been numerous design improvements in slug conveying and delivery areas for such brick handling equipment. For example, one is referred to the disclosures found in U.S. Pat. Nos. 3,716,264 and 4,173,911.

One approach for efficiently transferring slugs from an off bearing belt to a slug cutting device has involved grouping the slugs in pairs and conveying the grouped pair of slugs simultaneously to and through a slug cutting device. While such approaches have generally increased the delivery speed of slugs to the wire bank cutter, they have also involved expensive and complicated mechanisms and controls that have been in some cases unreliable and difficult to maintain.

Therefore, there is a need for a simple and relatively inexpensive conveying system and design for transferring brick slugs from an off bearing belt to and through a wire bank cutter in an efficient manner that will better utilize the capacity of the entire brick handling system.

SUMMARY AND OBJECTS OF INVENTION

The present invention entails a method and apparatus for conveying and transferring brick slugs, two at a time, from an off bearing belt to a slug cutter such as a wire bank cutter. Basic to the present invention is grouping slugs delivered to a discharge point in pairs. As grouped, the pair of slugs are horizontally aligned side-by-side relationship. After this, one slug is engaged and moved towards the other, engaging the latter, and the two slugs are moved and transferred simultaneously and together across an off bearing belt towards and to the wire bank cutter.

To accomplish this, the present invention entails a pusher-puller assembly disposed generally over the off bearing belt at the discharge point. The push-puller assembly is operative to engage a first slug delivered to said discharge point and to pull the same off the off bearing belt onto an adjacent slug support platform. After this a second slug is delivered to the discharge point on said off bearing belt. In the meantime, the pusher-puller assembly is actuated such that an engaging member thereof raises above the slug and moves over the same slug after which the engaging device is lowered to engage the opposite side of the first slug.

Next the pusher-puller assembly is actuated to move transversely, engaging the first slug and moving the same towards the second slug, where the first slug engages the second slug and both slugs are moved and transferred simultaneously and together across the off bearing belt towards to the wire bank cutter.

It is, therefore, an object of the present invention to provide an efficient conveying and delivery system for conveying and transferring slugs to a wire bank cutter in a brick handling system.

Another object of the present invention is to provide a slug conveying and delivery system for a brick handling system that is efficient, has a relatively large capacity, but which entails a relatively simple and inexpensive design mechanism for accomplishing such.

Still a further object of the present invention resides in the provision of a method and apparatus for conveying and deliverying brick slugs to a cutting station within a brick handling system that groups the respective slugs in groups of at least two slugs each, and then transfers the grouped slugs from a conveyor or conveyor assembly to and through an adjacent slug cutting device.

Other objects and advantages of the present invention will become apparent from a study of the following description and the accompanying drawings which are merely illustrative of the present invention.

METHOD AND APPARATUS FOR CONVEYING BRICK SLUGS FROM A CONVEYING SYSTEM TO A BRICK SLUG CUTTER

Figure 1:
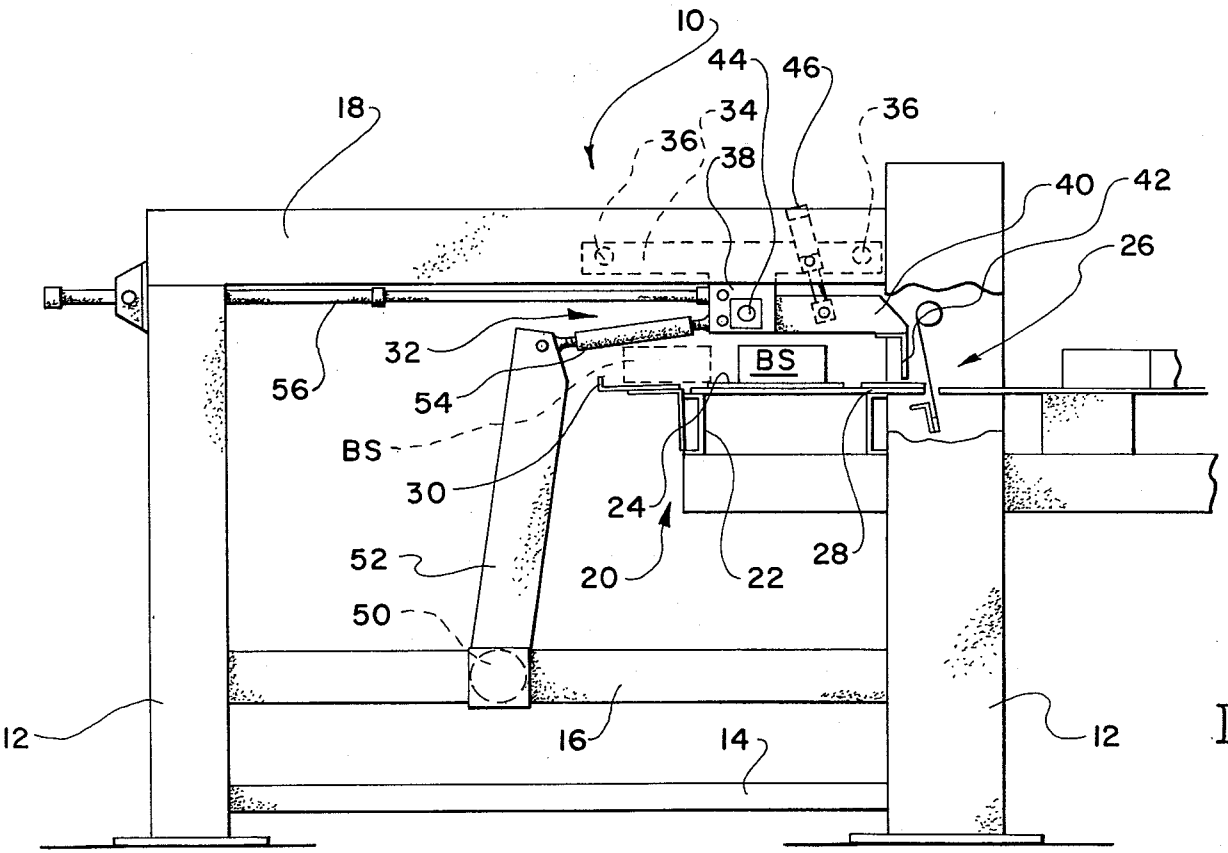
FIG. 1 is a side elevational view of a portion of a brick handling system illustrating the pusher-puller assembly of the present invention that is adapted to transfer brick slugs from an off bearing belt towards and to a brick slug cutting device.

With further reference to the drawings, and particularly FIG. 1, a brick handling system is shown therein and indicated generally by numeral 10. In such a brick handling system, the total system entails producing brick slugs, conveying them to a slug cutter, cutting the slugs into individual brick portions, and then appropriately arranging and stacking the cut brick portions on a kiln car where they are ready for curing and drying.

The present invention relates to that portion of the brick handling system where the respective brick slugs are conveyed to a discharge point and transferred therefrom towards and through a brick slug cutter. Thus, the subsequent specification and description will deal with that part of the brick handling system that comprises the slug conveying system, brick slug cutter, and a transfer assembly or mechanism for conveying slugs from the conveying system toward and through the brick slug cutter. For a more complete and unified understanding of such a complete brick cutter system, one is referred to the disclosure found in U.S. Pat. No. 3,716,264.

Turning now to the present invention, the slug conveying system is supported by a frame structure that includes a series of corner vertical posts 12 that are interconnected together by a lower interconnecting structure 14, an intermediate interconnecting structure 16, and a pair of upper guide rails 18.

Extending from one or more brick slug extruders (not shown) to the frame structure just described, is a slug conveying system, indicated generally by the numeral 20 and also referred to as an off bearing belt conveyor. Slug conveying system 20 includes a conveyor frame structure 22 secured at the discharge end of the frame structure just described. Slug conveying system 20 further includes an endless belt 24 that is appropriately disposed about the conveyor frame structure for transferring individual brick slugs BS from the extruder or extruders to a discharge point within the frame structure described hereinabove.

Slug conveying system 20 terminates adjacent a brick slug cutter in the form of a wire bank cutter indicated generally by the numeral 26. It should be appreciated that the wire bank cutter 26 and the slug conveying system 20 are arranged and designed such that during the process of conveying slugs from the conveying system 20 towards the wire bank cutter 26 that the conveying system is designed to position a respective slug BS at a discharge point where the slug is transversely aligned with the wire bank cutter 26. Expressed in another way, slug conveying system 20 is designed to deliver respective slugs BS to a discharge point where that respective slug is transversely aligned with the wire bank cutter 26 such that when the slug is advanced towards the wire bank cutter it will appropriately align therewith for proper cutting.

Disposed adjacent slug conveying system 20 and extending through a lower portion of the wire bank cutter 26 is a receiving and accumulating table 28. Table 28 serves to receive respective brick slugs conveyed left to right in FIG. 1 from the conveying system.

Disposed on the opposite side of slug conveying system 20 is a slug support platform or plate 30. Slug support platform 30 is likewise transversely aligned with wire bank cutter 26.

Disposed over slug conveying system 20 and slug support 30 is a pusher-puller assembly indicated generally by the numeral 32. Pusher-puller assembly 32 includes a movable carriage 34 having a series of wheels 36 with the wheel being confined within guide rails 18 such that the carriage 34 may move fore-and-aftly over the slug conveying system 20. Extending downwardly from carriage 34 is shoulder plate means 38 that have arm means 40 rotatively secured thereto about pivot axis 44. About the right end of arm means 40, as viewed in FIG. 1, there is provided an elongated pusher-puller plate 42 that has a pulling surface and an opposed pushing surface. Since arm means 40 is presently mounted about axis 44, there is provided tilt cylinder means 46 secured to said carriage 34 and operatively connected to arm means 40 for raising and lowering pusher-puller plate 42.

To stabilize carriage 34 during its fore-and-aft movement, there is provided a carriage stabilizer assembly operatively interconnected between the frame structure of the brick handling system and the carriage itself. Viewing carriage stabilizer assembly 48, it is seen that the same includes a torsion shaft 50 journaled between intermediate connecting members 16. Secured to torsional shaft 50 is a pair of arms 52 with each arm including a connecting link 54 secured to the upper end thereof and secured about the other end to carriage 34.

Carriage 34 is moved fore-and-aftly in a selected time relationship with the conveyor system 20 by a controlled hydraulic cylinder 56 that is supported by the frame structure of the brick handling system 10.

Figure 2:
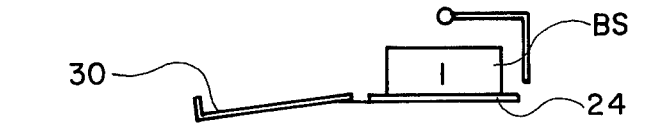
FIGS. 2 through 8 are a series of sequence views illustrating the operation of said pusher-puller assembly and the movement of brick slugs in the course of transferring the same from an off bearing belt towards the brick slug cutter.
Figure 3:
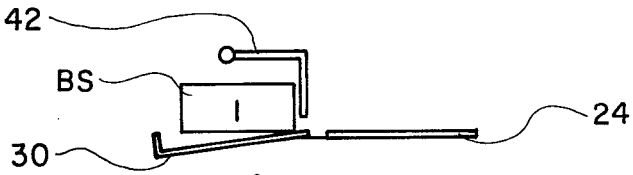

Viewing the operation of the present invention and with particular reference to sequence views 2–8, it is seen that first the pusher-puller assembly is disposed in an extreme right-hand position as viewed in FIGS. 2 through 8. A first slug is delivered on said conveyor system 20 to a discharge point adjacent slug support 30 and transversely aligned with wire bank cutter 26. Once the first slug has reached the discharge point, hydraulic cylinder 56 is automatically actuated causing the carriage 34 to be moved to the left as viewed in FIGS. 1 through 3. Pusher-puller plate 42 engages the right-hand edge of the first brick slug, and the first brick slug is moved over the conveyor belt 24 onto slug support 30 (FIG. 3).

Next tilt cylinder means 46 is actuated causing arm means 40 to be elevated such that the pusher-puller plate 42 is raised to an elevation over the first slug. In the meantime, a second slug is delivered on said conveyor system 20 to the discharge point and stopped thereat such that the first and second slugs are transversely aligned and disposed in side-by-side relationship (FIGS. 4 and 5).

Figure 4:
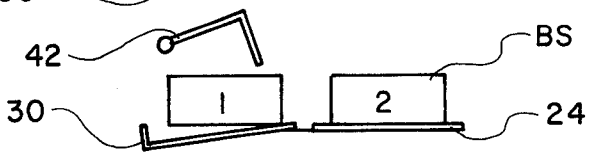
Figure 5:
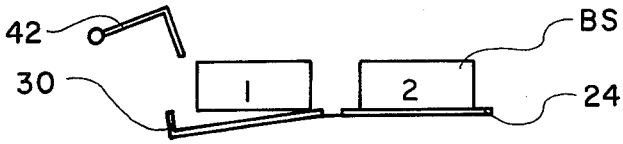
Figure 6:
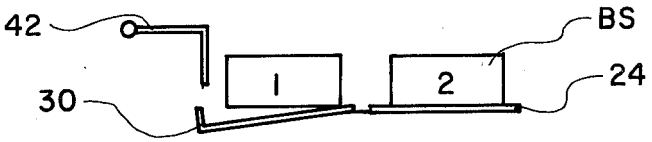
Figure 7:
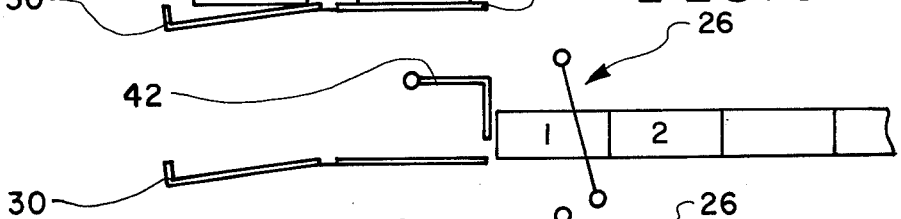
Figure 8:
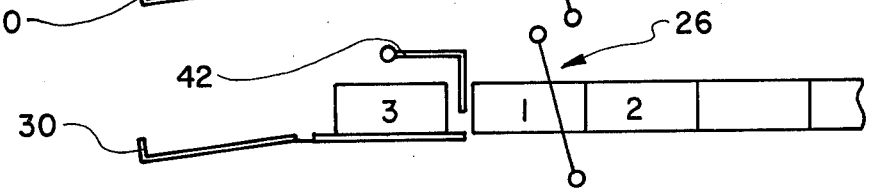

After pusher-puller plate 42 has been elevated to a position as shown in FIG. 4, carriage 34 is actuated once more to the left as viewed in the drawings and moved to a left-hand extreme position as shown in FIG. 5. Once in the left-hand extreme position, the tilt cylinder means 46 is actuated to lower the pusher-puller plate 42 to a lower position adjacent the left-hand side edge of the first slug resting on slug support 30 (FIG. 6). Next, carriage 34 is actuated through hydraulic cylinder 56 to move from its extreme left-hand position (FIG. 6) to its extreme right-hand position (FIGS. 2 and 7). As carriage 34 moves left to right, it engages the first slug which in turn engages the second slug and both slugs are pushed across conveyor system 20 towards and to wire bank cutter 26 (FIG. 7). In the extreme right-hand position, the pusher-puller plate 42 assumes the same position shown in FIG. 2 and is now ready for the next slug to be delivered to the discharge point after which the same can be pulled as indicated in FIGS. 2 and 3 to the left such that the slug is transferred to the slug support 30.

It is appreciated that as the pusher-puller plate 42 pushes brick slugs BS to the right and through wire bank cutter 26 that the cut brick slugs accumulate onto a receiving or accumulating table disposed and extending to the right of the wire bank cutter. These accumulated bricks are then stacked or otherwise appropriately arranged to be transferred by a device such as that shown in U.S. Pat. No. 3,716,264 to a kiln car for curing and drying. Details of the brick handling system beyond the wire bank cutter 26 are not dealt with herein in detail because such is not material per se to the present invention and further because various known systems exist and can be utilized in conjunction with the present invention.

From the foregoing specification, it is appreciated that the present invention entails a very efficient method and apparatus for transferring brick slugs from an off bearing belt to and through a wire bank cutter. The design of the transfer mechanism is such that the same is relatively simple and inexpensive but yet easy to operate and maintain.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A brick handling system for simultaneously transferring at least two brick slugs at a time from a conveying system towards a slug cutting device where the slugs are cut into individual bricks as they are conveyed therethrough; said brick handling system comprising: conveying means for receiving slugs and transferring them in sequence to a discharge point thereon; a brick slug cutting device disposed adjacent one side of said conveying means in the vicinity of said discharge point and appropriately aligned with said conveying means and discharge point for receiving slugs moved from said discharge point and cutting the same into individual bricks; slug support means disposed adjacent said conveying means on a side opposite said slug cutting device and normally assuming a transfer position where said slug support means is generally horizontally aligned with said conveying means such that slugs can be conveniently horizontally moved between said conveying means and said support means; and slug transfer means disposed adjacent said conveying means in the vicinity of said discharge point for simultaneously conveying two consecutively arriving and horizontally aligned slugs towards said brick cutting device, said slug transfer means including first engaging means for engaging a first slug on said conveying means at said discharge point and conveying said slug onto said support means after which said conveying means conveys a second consecutive slug to said discharge point; said transfer means including second engaging means for simultaneously conveying said first and second consecutive slugs, one after another in single tier fashion, directly across and over said conveying means towards said slug cutting device; said second engaging means including means for engaging said first slug on said support means while said support means is disposed in said transfer position and generally horizontally aligned with said conveying means for conveying said first slug from said support means towards said conveying means and said second consecutive slug and into engagement with said second consecutive slug for conveying said first and second consecutive slugs simultaneously directly over said conveying means towards said slug cutting device.

2. A method of conveying two consecutively received brick slugs, one after another in single tier fashion, to and through a slug cutting device, comprising steps of:

(a) conveying a first slug on conveying means to a discharge point;

(b) transferring said first slug laterally from said conveying means to an adjacent slug support structure disposed on one side of said conveying means and normally assuming a transfer position where said slug support structure is generally horizontally aligned with said conveying means;

(c) conveying a second consecutive slug to said discharge point on said conveying means;

(d) conveying said first slug generally horizontally from said support means, while said support means is disposed in said transfer position, back towards said conveying means and engaging said second consecutive slug on said conveying means with said first slug;

(e) conveying said first slug directly over and across said conveying means towards the other side of said conveying means opposite said support structure and engaging said second consecutive slug on said conveying means and conveying said first and second consecutive slugs, one after another in single tier fashion, directly over and across said conveying means towards said cutting device;

(f) continuing to convey said first and second consecutive slugs together, one after another in single tier fashion, toward said slug cutting device disposed adjacent said conveying means on the side thereof opposite said support structure; and (g) continuing to transfer slugs in sequence to said discharge point and to simultaneously transfer at least two consecutive slugs at a time from said support structure and conveying means towards said slug cutting device such that as said slugs are conveyed towards said slug cutting device, respective slugs pass through said slug cutting device and are cut into a plurality of brick-like portions.

3. The method of claim 2 wherein the step of transferring said first slug laterally from said conveying means to an adjacent slug support structure includes engaging one side edge of said first slug with an engaging surface and moving said engaging surface towards said slug support structure so as to move and transfer said first slug from said conveying means to said slug support structure; and wherein said method further includes elevating said engaging surface to a height above said first slug; moving said engaging surface laterally to the other side of said first slug; lowering said engaging surface to a position where the same horizontally aligns with said first slug; and engaging an outer edge of said first slug and moving the engaged slug towards said second slug such that the first slug engages the second slug and said first slug is continued to be moved so as to cause both slugs to be simultaneously moved towards said slug cutting device.

4. A brick handling apparatus for conveying at least two brick slugs at a time from a slug conveying device towards and through a brick slug cutting device, comprising:

(a) slug conveying means for conveying slugs thereon to a discharge point;

(b) slug support means disposed adjacent said conveying means and in the vicinity of said discharge point for receiving slugs from said conveying means;

(c) slug cutting device disposed adjacent said conveying means in the vicinity of said discharge point for cutting slugs into a plurality of brick-like portions as slugs are pushed therethrough; and (d) a pusher-puller assembly movably mounted above said conveying means and said slug support means for arranging at least two slugs in side by side alignment and simultaneously transferring the two slugs towards said slug cutting device, said pusher-puller assembly comprising:

(1) a frame structure;

(2) carriage means movably mounted within said frame structure and movable between first and second positions;

(3) push-pull means operatively connected to said carriage means and movable therewith for selectively engaging one side edge of a first slug and transferring the same from said conveying means to said slug support means after which a second slug is conveyed to said discharge point such that said first and second slugs are horizontally aligned in side by side relationship;

(4) lift means operatively associated with said push-pull means for raising and lowering the same in order that said push-pull means may be moved over said first slug and then lowered to engage the other opposite edge of said first slug; and (5) said push-pull means being movable to push said first slug from said slugs support means back towards said conveying means and across said conveying means and in the process engaging said second slug on said conveying means and wherein said push-pull means acts to convey both said first and second slugs simultaneously towards said slug cutting device.

5. The brick handling apparatus of claim 4 wherein said push-pull means includes a generally L-shaped structure including a generally flat elongated plate having opposed sides, with one side serving as a pulling side while the other side serves as a push side.

* * * * *